US011280255B2

(12) United States Patent
Bendle

(10) Patent No.: US 11,280,255 B2
(45) Date of Patent: Mar. 22, 2022

(54) FOSSIL FUEL CATALYZATION SYSTEM USING NEGATIVE CHARGE TO FUEL INJECTOR IN ORDER TO INCREASE BURN/COMBUSTION EFFICIENCY

(71) Applicant: Keith Bendle, Flint, MI (US)

(72) Inventor: Keith Bendle, Flint, MI (US)

( * ) Notice: Subject to any disclaimer, the term of this patent is extended or adjusted under 35 U.S.C. 154(b) by 0 days.

(21) Appl. No.: 16/908,826

(22) Filed: Jun. 23, 2020

(65) Prior Publication Data

US 2020/0408136 A1 Dec. 31, 2020

Related U.S. Application Data

(60) Provisional application No. 62/866,102, filed on Jun. 25, 2019.

(51) Int. Cl.

| | |
|---|---|
| ***F02B 27/02*** | (2006.01) |
| ***F02M 35/10*** | (2006.01) |
| ***F02M 27/04*** | (2006.01) |

(52) U.S. Cl.

CPC ..... *F02B 27/02* (2013.01); *F02B 27/0205* (2013.01); *F02M 27/04* (2013.01); *F02M 35/10249* (2013.01)

(58) Field of Classification Search

CPC ..... F02B 27/02; F02B 27/0205; F02M 27/04; F02M 2027/047; F02M 35/10249

See application file for complete search history.

(56) References Cited

U.S. PATENT DOCUMENTS

| | | | | |
|---|---|---|---|---|
| 4,069,801 | A * | 1/1978 | Stevens | F02P 3/0838 123/595 |
| 4,389,983 | A | 6/1983 | Enga et al. | |
| 7,752,845 | B2 | 7/2010 | Johnson | |
| 8,082,892 | B2 | 12/2011 | Zhao et al. | |
| 9,209,654 | B2 | 12/2015 | Colannino et al. | |
| 9,404,449 | B2 | 8/2016 | Licitar | |
| 9,696,031 | B2 | 7/2017 | Goodson et al. | |
| 9,909,759 | B2 | 3/2018 | Goodson et al. | |
| 10,106,755 | B2 | 10/2018 | Horst | |
| 2005/0011500 | A1* | 1/2005 | Allen | F02M 27/04 123/537 |
| 2005/0279332 | A1* | 12/2005 | Zhang | F02M 27/06 123/538 |
| 2007/0181104 | A1* | 8/2007 | Collins | F02M 31/125 123/537 |
| 2009/0056670 | A1 | 3/2009 | Zhao et al. | |

FOREIGN PATENT DOCUMENTS

WO 2006/017915 A2 2/2006

* cited by examiner

*Primary Examiner* — Syed O Hasan

(74) *Attorney, Agent, or Firm* — Dinsmore & Shohl LLP

(57) ABSTRACT

A system, apparatus and associated method for the catalyzation of a fossil fuel prior to combustion within an internal combustion engine. A voltage is inputted from a source to a relay and an ignition circuit in separate communication with the relay. The relay converts the input voltage to a negative output voltage applied to a fuel line in communication with a fuel injector of the engine, resulting in a negative charge imparted to the fuel prior to combustion and in order to increase oxidation/burn efficiency with resultant mileage/horsepower increase and concurrent decrease in pollutants resulting from discharge of partially combusted reactants.

6 Claims, 1 Drawing Sheet

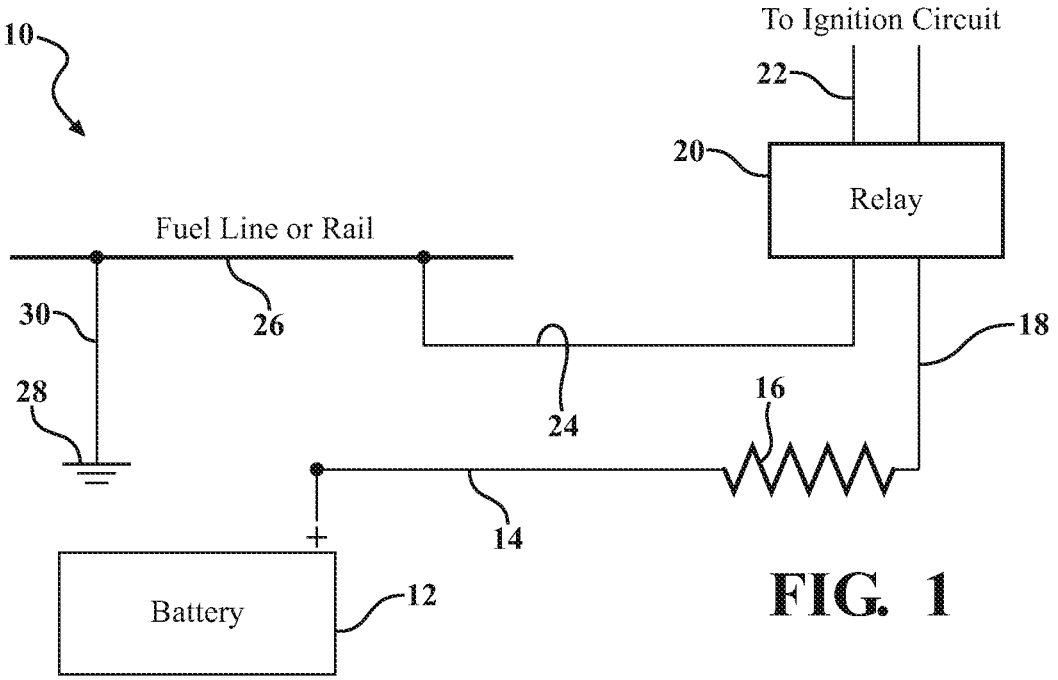
FIG. 1
FIG. 2
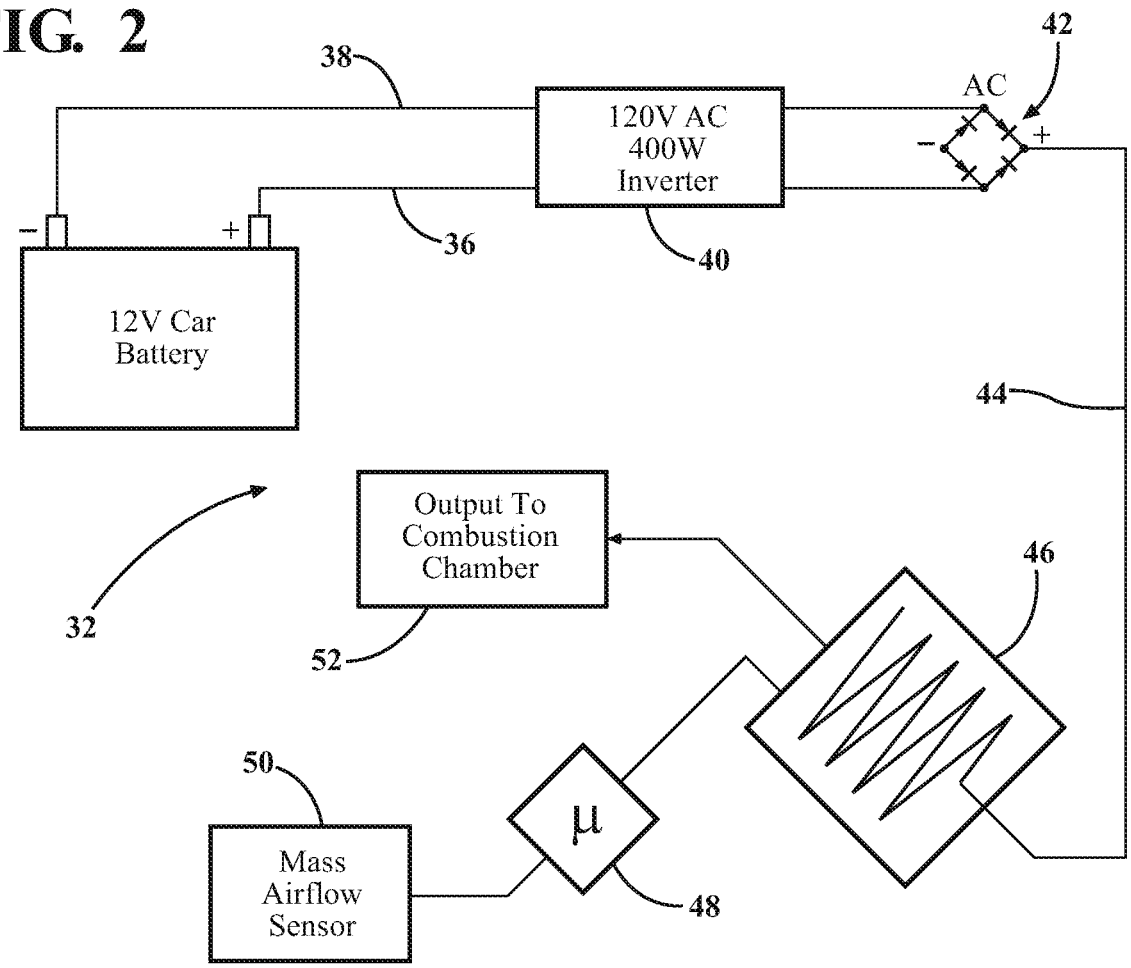

FOSSIL FUEL CATALYZATION SYSTEM USING NEGATIVE CHARGE TO FUEL INJECTOR IN ORDER TO INCREASE BURN/COMBUSTION EFFICIENCY

CROSS REFERENCE TO RELATED APPLICATIONS

The present application claims the priority of U.S. Ser. No. 62/866,102 filed Jun. 25, 2019.

FIELD OF THE INVENTION

The present invention relates generally to techniques for improving combustion/burn efficiency of fossil fuels. More specifically, the present invention discloses a system, apparatus and associated method or process for the catalyzation (most generally defined as being the initiation of a chemical reaction) of a fossil fuel at the point of combustion. The assembly and associated process teaches the application of the small negative charge, such as to the fuel as it is conveyed into a fuel injection line preceding combustion.

Typically, a small electric charge is added to an already existing slight electron chemical negative charge, this resulting in a significant oxidation reaction of the fuel which, during combustion, is accompanied by a significant increase in burn/combustion efficiency, with resultant increase in fuel mileage/horsepower output per gallon of any internal combustion engine application within which the system is integrated, and along with reduction of pollutant emissions. A further variant of the invention additionally or alternatively contemplates providing a positive electron charge to a supply of oxygen concurrently fed into the combustion chamber along with the injected fuel, to achieve similar objectives.

BACKGROUND OF THE INVENTION

The prior art is documented with systems and assemblies for maximizing the combustion efficiency of a fuel mixture at the point of combustion.

Fossil fuels, such as coal, oil and natural gas, are created when organic matter decays and becomes compressed beneath layer upon layer of sand, earth, rock and ocean. The name "fossil fuel" is actually derived from the word "fossil" denoting the mineralized remains of ancient creatures which once populated the earth. Burning fossil fuels yields carbon dioxide, water and energy; the process of burning fossil fuels is known as "combustion".

During chemical reactions, energy is either absorbed into the environment (endothermic reaction) or released into the environment (exothermic reaction), during which chemical bonds are broken and formed. Bond making is an exothermic process, while bond breaking is an endothermic process. As is further known, combustion reactions require oxygen. Fossil fuels are composed primarily of hydrocarbons, which are converted into carbon dioxide and water during a combustion reaction.

As is further known, combustion references the rapid oxidation of fuel accompanied by the production of heat, or heat and light. Complete combustion of a fuel is possible only in the presence of an adequate supply of oxygen.

Examples of existing systems drawn from the prior art include the combustion system of Goodson U.S. Pat. No. 9,909,759, in which a charge source is configured to cooperating with a collection plate and a director conduit to cause at least one particle charge-to-mass classification to be reintroduced to a flame for further reaction.

Horst, U.S. Pat. No. 10,106,755, teaches a fuel additive that includes adducts which have been formed in a solution of metallic ions, ethanol and water. The adducts are formed for the fuel additive when the solution is electromagnetically radiate and exist strong permanent dipoles that will influence the temporary dipoles of hydrocarbons in untreated fuel. As further disclosed, the hydrocarbons in the treated fuel will exhibit permanent dipoles that more effectively interact with oxygen molecules from air when the treated fuel is atomized in air in a combustion chamber.

Finally, Colannino U.S. Pat. No. 9,209,654 teaches an apparatus for enhancing flame radiation including a flame charging system and an electrically isolated electrode. A time-varying voltage is applied to the flame charging system which imparts a corresponding time-varying charge or voltage onto the flame, which in turn responds to the time-varying charge/voltage by increasing its luminosity.

SUMMARY OF THE PRESENT INVENTION

The present invention discloses a system, apparatus and associated method for the catalyzation of a fossil fuel prior to combustion within an internal combustion engine. A voltage is inputted from a source to a relay and an ignition circuit is in separate communication with the relay.

The relay converts the input voltage to a negative output voltage applied to a fuel line in communication with a fuel injector of the engine, resulting in a negative charge imparted to the fuel prior to combustion and in order to increase oxidation/burn efficiency with resultant mileage/horsepower increase and concurrent decrease in pollutants resulting from discharge of partially combusted reactants.

Additional features include the voltage source including a battery. A switch is provided for activating the battery to output the current flow through a resistor prior to the relay. The fuel line is further connected to an electrical ground location. In a further variant, a positive electron charge is supplied to an oxygen airflow concurrently being fed to the injector.

BRIEF DESCRIPTION OF THE DRAWINGS

Reference will now be made to the attached drawings, when read in combination with the following detailed description, wherein like reference numerals refer to like parts throughout the several views, and in which:

FIG. 1 is a schematic of fossil fuel catalyzation circuit of general application to any internal combustion engine and in particular for providing for the introduction of a modest negative electrical charge to a fossil fuel within an injector, at the point of combustion, and in order to increase oxidation/burn efficiency with resultant mileage/horsepower increase and concurrent decrease in pollutants resulting from discharge of partially combusted reactants; and FIG. 2 is a schematic of a further application of the present invention for providing a positive electron charge to a supply of oxygen concurrently fed into the combustion chamber along with the injected fuel, to achieve similar objectives.

DETAILED DESCRIPTION OF THE PREFERRED EMBODIMENTS

With reference now to the following description, the present invention discloses a system, apparatus and associated method or process for the catalyzation (as most generally defined being the initiation of a chemical reaction) of a fossil fuel at the point of combustion. As will be described in detail, the assembly and associated process teaches the application of the small negative charge, such as to the fuel as it is conveyed into a fuel injection line preceding combustion.

With reference to FIG. 1, a schematic is shown, generally at 10, of fossil fuel catalyzation circuit of general application to any internal combustion engine (not shown) and in particular for providing for the introduction of a modest negative electrical charge to a fossil fuel within an injector, at the point of combustion, and in order to increase oxidation/burn efficiency with resultant mileage/horsepower increase and concurrent decrease in pollutants resulting from discharge of partially combusted reactants. A battery (or any substitute voltage supply source) is referenced at 12 and, upon being activated by a switch or the like (not shown) outputs a current flow voltage along a conduit or wire 14, through a resistor 16 and to a series connected conduit or wire 18 leading to a relay 20.

The relay 20 is also communicated by an ignition circuit 22 and, upon being activated, converts to a negative the input voltage supplied from the battery for feeding, via an output conduit/wire 24, to any of a fuel line or rail 26 associated with a fuel injector assembly. The fuel line or rail is further connected to a ground location, as depicted at 28 via line 30.

Typically, a small electric charge is added to an already slight electron chemical negative charge, resulting in a significant oxidation reaction of the fuel which, during combustion, results in significant increase in burn/combustion efficiency, with resultant increase in fuel mileage/horsepower output per gallon of an internal combustion engine within which the system is integrated, along with reduction of pollutant emissions.

Preliminary testing of electrical values added to the negative charges of the feel have yielded values in a range of twelve volts (12V), five amps (5 A) to twelve volts (12V), twenty amps (20 A) on the negative side of the fuel, resulting in increased heat efficiency. As is known, the thermal efficiency of a heat engine is the percentage of heat energy that is transformed into work. The efficiency of even the best conventional heat engines is low, usually below 50% and often far below. In the present application, corresponding efficiencies of 50% and greater are possible.

With reference to FIG. 2, a further variant of the invention is generally depicted at 32 and additionally or alternatively contemplates providing a positive electron charge to an oxygen input prior to introducing into the injector along with the fuel, and to thereby achieve similar objectives. A voltage source, such as a 12V car battery 34, includes both positive 36 and negative 38 leads which communicate with an inverter component 40 (such as 120V AC 400 W).

The inverter 40 communicates with a bridge rectifier 42. As is known, a diode bridge is an arrangement of four diodes in a bridge circuit configuration that provides the same polarity of output for either polarity of input. When used in its most common application, for conversion of an alternating-current input into a direct-current output, this further referenced by +DC ONL output 44.

A vehicle air intake component is shown at 46 and includes a small galvanized mesh screen or Truman cell. In the latter instance, such air purifiers use EP (Electrostatic Precipitator) technology to attract particles to the filter.

By this arrangement, a positive charge is added to the air intake drawn through component 46 for delivery to the given cylinder combustion chamber (not shown) concurrent with the introduction of fuel through the fuel injectors. A separate processor 48, provides for adjustment of at an air intake value, such as via one or more mass airflow sensors 50 positioned in proximity to the intake component, and which is applied to the mesh screen or Truman Cell 46 in order to adjust the positively charged air input to the vehicle combustion chamber (generally referenced at 52), In this fashion, and as the O2 sensor becomes more positively charged, the associated processor component will modify/reduce the air intake value through the use of mass air flow sensors with the net result being substantially constant horsepower and fuel efficiency (mileage).

The variant of FIG. 2 acknowledges the existence of limits to electrical catalyzation of fossilitic fuels, as it is presently unknown if a complete burn within the combustion chamber is possible. At typical revolution per minute (RPM) rates of 750 RPM (idle speed) to 6,000 RPM (max speed when all pistons are firing at ½ RPM speed for a four stroke engine), this translating to a range of between 375 time/minute (6.25 times/second) up to 3,000 times/minute (50 times/second). At an average velocity of 3000 RPM twenty five explosions/second occur which can result in difficulties in obtaining a complete burn within the combustion chamber. Other features can include a relayed on/off switch added to associated ignition relays.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A system for the catalyzation of a fossil fuel prior to combustion within an internal combustion engine, comprising:

a voltage supplied from a source and inputted to a relay;

an ignition circuit in separate communication with said relay;

a positive electron charge supplied to an oxygen airflow concurrently being fed to a fuel injector of the engine;

a voltage source, such as a 12V car battery having both positive and negative leads which communicate with an inverter component;

a vehicle air intake component; and a processor providing for adjustment of an air intake value applied to the vehicle intake component in order to adjust the positively charged air input to a vehicle combustion chamber;

said inverter component communicating with a bridge rectifier for conversion of an alternating-current input into a direct-current output; and said relay converting the input voltage to a negative output voltage for delivery to a fuel line in communication with the fuel injector of the engine, resulting in a negative charge imparted to the fuel prior to combustion in order to increase oxidation/burn efficiency with resultant mileage/horsepower increase and concurrent decrease in pollutants resulting from discharge of partially combusted reactants.

2. The invention as described in claim 1, the source further comprising a battery.

3. The invention as described in claim 2, further comprising a switch for activating the battery to output the current flow voltage through a resistor prior to the relay.

4. The invention as described in claim 3, further comprising the fuel line connected to an electrical ground location.

5. The invention as described in claim 1, said air intake component further comprising either of a galvanized mesh screen or an electrostatic precipitator.

6. The invention as described in claim 1, further comprising one or more mass air flow sensors for instructing said processor for adjustment of the air intake value.

* * * * *